US005824970A

United States Patent [19]

Gracia

[11] Patent Number: 5,824,970

[45] Date of Patent: Oct. 20, 1998

[54] MARINE ENGINE SILENCER HAVING INTERNAL APERTURED BAFFLE AND WEIR PLATE

[76] Inventor: Albert Louis Gracia, Freshfields, Dorchester Road, Lytchett Minster, Poole, Dorset, Great Britain, BH16 6JF

[21] Appl. No.: 776,027

[22] PCT Filed: Jul. 19, 1995

[86] PCT No.: PCT/GB95/01712

§ 371 Date: Jan. 23, 1997

§ 102(e) Date: Jan. 23, 1997

[87] PCT Pub. No.: WO96/02740

PCT Pub. Date: Feb. 1, 1996

[30] Foreign Application Priority Data

Jul. 20, 1994 [GB] United Kingdom ..... 9414656

[51] Int. Cl.[6] ..... F01N 7/08

[52] U.S. Cl. ..... 181/228; 181/235; 181/260

[58] Field of Search ..... 181/227, 228, 181/235, 259, 260, 261, 262, 263, 264, 267, 281, 283

[56] References Cited

U.S. PATENT DOCUMENTS

| | | | |
|---|---|---|---|
| 1,821,688 | 9/1931 | Bourne . | |
| 1,922,848 | 8/1933 | Harley | 181/228 |
| 2,396,952 | 3/1946 | Huber | 181/283 |
| 2,933,148 | 4/1960 | Hendry | 181/235 |
| 3,077,240 | 2/1963 | Betts . | |
| 3,191,714 | 6/1965 | Phillips | 181/235 |
| 4,825,652 | 5/1989 | Curran . | |
| 5,123,501 | 6/1992 | Rothman et al. | 181/227 |
| 5,661,272 | 8/1997 | Iannetti | 181/267 |

FOREIGN PATENT DOCUMENTS

| | | |
|---|---|---|
| 646808 | 11/1928 | France . |
| 411250 | 3/1934 | United Kingdom . |
| 632120 | 1/1950 | United Kingdom . |

*Primary Examiner*—Khanh Dang

*Attorney, Agent, or Firm*—Burns, Doane Swecker & Mathis LLP

[57] ABSTRACT

A silencer is provided for a marine diesel engine. The silencer comprises a conical silencer element (20) located within an exhaust duct (10), the silencer element having apertured surfaces which are inclined to the flow of exhaust gases in the duct.

13 Claims, 3 Drawing Sheets

MARINE ENGINE SILENCER HAVING INTERNAL APERTURED BAFFLE AND WEIR PLATE

This invention relates to exhaust silencers for internal combustion engines and in particular relates to the silencing of marine and other installations where water is injected into the silencer.

An exhaust system for an internal combustion engine will comprise a pipe connected by a manifold to the exhaust ports of the engine and will have one or more silencers positioned along its length. The silencers reduce the velocity of the exhaust gases and reduce the noise emitted. At the same time, the exhaust gas pressure (known as the back pressure) is increased within the exhaust pipe.

A silencer typically comprises a box which is 3 to 5 times the diameter of the exhaust pipe. Inside each silencer box there is an arrangement of baffle elements positioned to confront the exhaust gas flow and reduce the speed of this flow. Such arrangements may increase the back pressure to the point where engine efficiency is prejudiced. To enable back pressures to be maintained at appropriate levels, the silencers may need to be quite large and as such may intrude into the engine compartment. The silencer housing has to be securely fixed to the hull, e.g. in order to prevent reverberation, and the necessary fixing stays require additional space. In the case of marine engines, in particular, engine cooling water is often injected into the exhaust gases which produces a decrease in gaseous volume and further reduces the gas velocity.

An object of the invention is to provide an effective silencing system having compact dimensions and which is of such a size that it can be contained in the exhaust pipe from the engine.

A further object of the invention is to provide a silencing system which produces a substantial reduction in exhaust noise while maintaining exhaust back pressure within acceptable limits.

In accordance with the invention there is provided an exhaust silencer having a high ratio of internal surface area to cross-sectional area.

In one form of the invention the silencer comprises at least one baffle element situated within a cylinder, wherein the baffle element is inclined towards the axis of the cylinder and wherein the baffle element has a number of apertures therethrough.

According to a more preferred aspect there is provided a silencer for a water-cooled exhaust gas system which comprises a tubular silencer element located within an exhaust duct, said silencer element comprising a baffle having apertured surfaces inclined to the flow of exhaust gas in the duct.

In a preferred embodiment the silencer has a tubular, tapering shape and may, for example, comprise a conical arrangement (including a truncated conical shape) wherein an axis of the cone lies in the direction of the exhaust gas flow. Where the silencer has a tapering, tubular shape, the taper may be continuous or stepped. Along the surface of the cone are arranged apertures which provide a baffle arrangement but, by virtue of the angled conical surface, the back pressure is maintained within acceptable levels.

In another aspect of the invention there is provided a silencer baffle of a shallow V section configuration in longitudinal section, wherein the surfaces of the baffle have a number of apertures of varying sizes.

Preferably, the apertures are larger in size or total area towards the top of the body of the silencer. This tends to cause the water in the exhaust gases to pass more readily through the silencer. The desired degree of back pressure is achieved by selecting the proportion of open area in the silence body. By 'proportion of open area' is meant the sum of the total area of the apertures as a proportion of the total surface area of the silencer surface. Generally, a proportion of 10 to 40%, preferably 25 to 35% is employed for most engines.

In order to further improve the mixing of exhaust gases and water and promote the escape of water through the silencer apertures, one or more weir plates can be fitted to the silencer. A weir plate typically extends generally axially to the tubular body of the silencer. An additional, substantially radial plate partially blocks off the face of the inlet to the silencer body below the weir plate. This has the effect of throttling the flow to the lower part of the silencer, but leaving unrestricted the flow in the upper part of the silencer.

Reference will now be made to the Figures of the accompanying drawings, in which.

Figure 4:
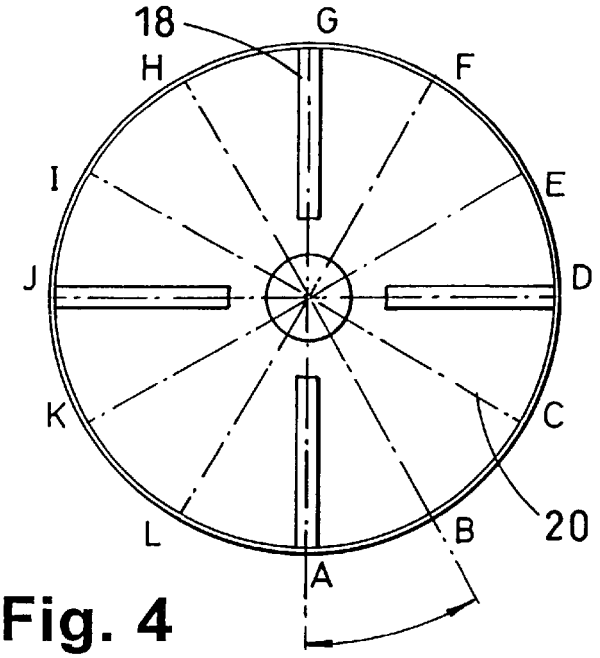
FIG. 4 shows an end view of the silencer shown in FIG. 3.
Figure 5:
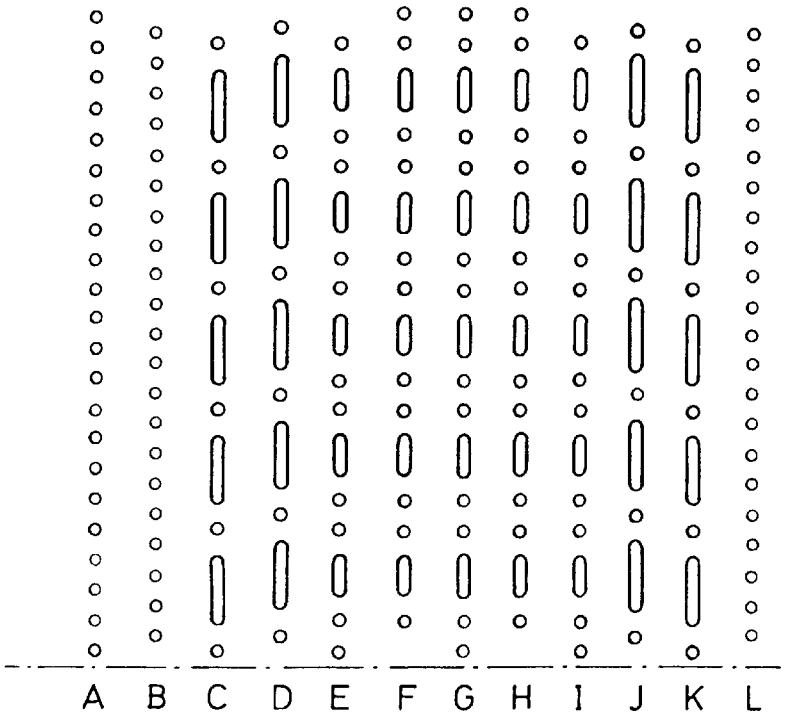
Figure 6:
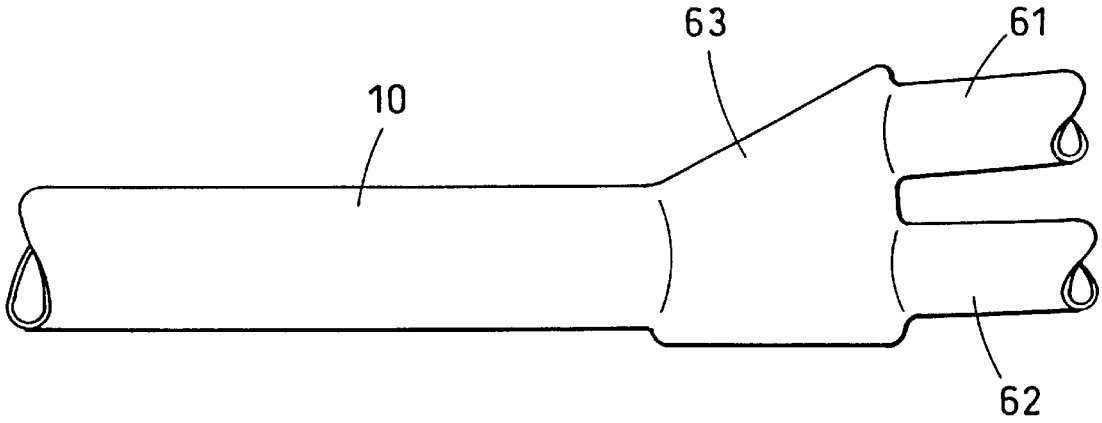

FIG. 5 details a typical arrangement of apertures along lines A to L of the conical baffle shown in FIG. 4;

FIG. 6 shows an external view of the silencer casing; and

Figure 7:
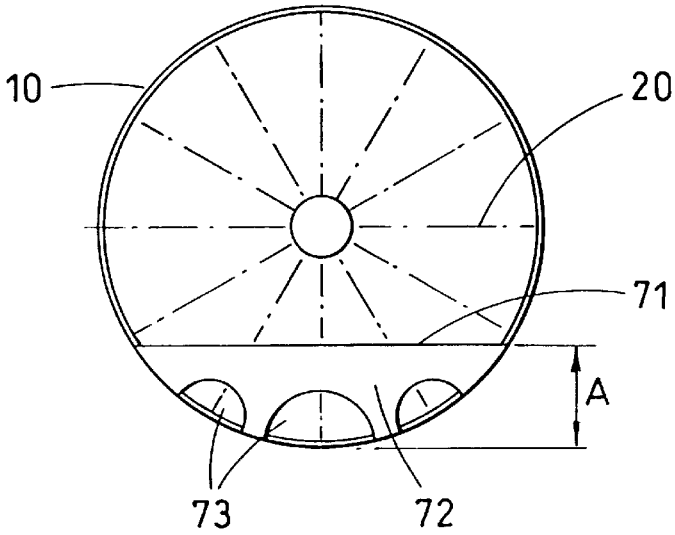

FIG. 7 is a view of a modified silencer from its open end.

Figure 3:
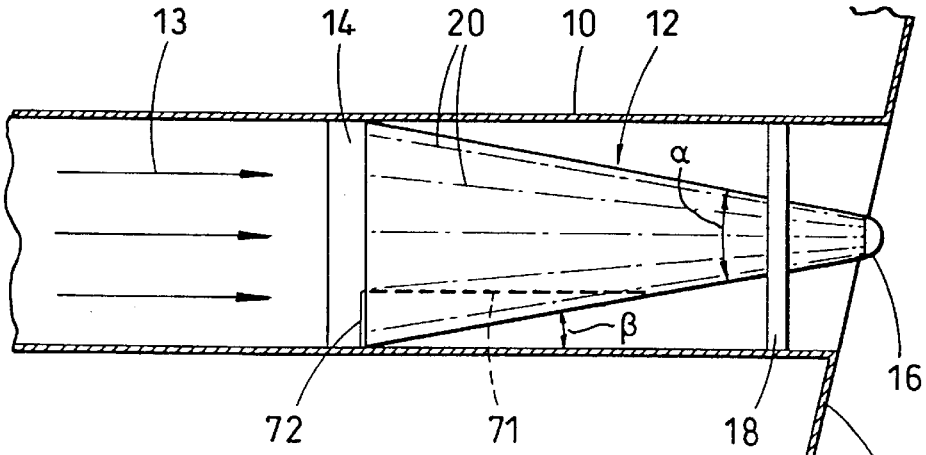
FIG. 3 shows a schematic view of a silencer installation made in accordance with the present invention.

Referring now to FIGS. 3 to 5, these show one embodiment of the invention fitted in the exhaust pipe of a marine diesel installation. Typically, exhaust gases from the engine will be lead by more or manifolds to the silencer. Before entry into the silencer, the exhaust gases will be subjected to a water spray. The water can be provided by a dedicated pump or may be derived from the engine cooling system. If turbochargers are fitted, then these are placed on the air/fuel inlet and exhaust outlet sides of the manifold before the addition of a coolant spray. The installation comprises a conical baffle 12 having an open base 14 for receiving the exhaust gas flow 13 within the exhaust pipe 10. Exhaust pipe 10 is fitted to the transom 15 of the vessel. The conical baffle 12 is dimensioned so as to fit within and be supported by cross members 18 within the exhaust pipe 10. The base portion 14 of the cone is preferably cylindrical but may be polygonal, e.g. hexagonal or octagonal and may be attached to the exhaust pipe by welding. The apex of the cone is terminated by a part-spherical or curved radius cap 16. Preferably, the cone angle ($\alpha$) is between 15° and 30°; most preferably 15° to 25°, e.g. about 22° to 23°. The apertured baffle surfaces of the silencer element 20 preferably form an angle with the walls of the exhaust duct 10 of about 5° to 20°; most preferably 8° to 15°, e.g. about 11° to 12°.

A series of apertures A to L are arranged along lines 20 of the cone extending from the base portion 14 to the cap 16 and each series of apertures comprises a sequence of circular holes and/or slots. The holes and slots as shown are equidistant from each other but this is not mandatory. Alternatively, the holes and slots may be arranged in a less ordered fashion. The linear arrangement of apertures is provided primarily for design and manufacturing convenience. It is believed that the different positions of the differently sized and shaped apertures aid in providing a sufficient back pressure, yet allow the mixture of exhaust gases in cooling water to be well mixed. It is thought that the large number of relatively small holes allow intimate mixing of the exhaust gases and the cooling water. This results in a uniform reduction in exhaust gas volume thereby reducing exhaust gas speed and, accordingly, reducing back pressure. This is also accompanied by reduction in noise. The arrangement of apertures can be optimised for each application with a knowledge of details of the type of installation such as exhaust gas speeds, exhaust gas volume, cooling water (saline or otherwise) and proximity of exhaust outlet to engine.

Figure 1:
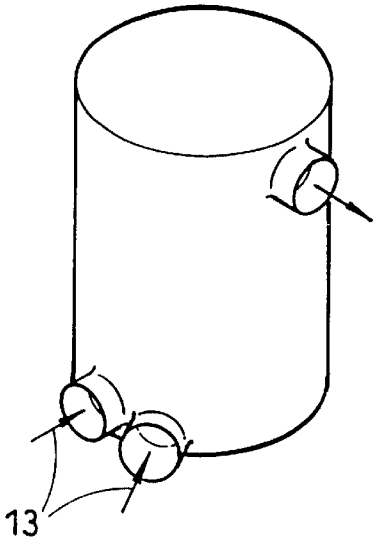
Fig. 1 PRIOR ART
FIG. 1 shows a perspective view of a typical prior art exhaust silencer.
Figure 2:
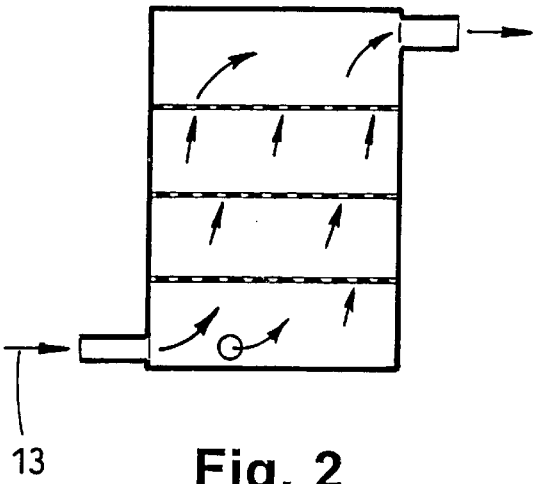
Fig. 2 PRIOR ART
FIG. 2 shows a part-sectional view showing the internal configuration of the baffle elements of the prior art silencer of FIG. 1.

FIGS. 1 and 2 show a typical prior art silencer for an 1100 HP marine diesel; the dimensions for this circular cylindrical silencer are 0.6 metre diameter and 1.1 metre height. The installation within an engine room can lead to a considerable loss of spacing, leading to problems in maintenance and/or limiting size of engine in a given engine room. The large size of these prior art silencers, together with high exhaust gas velocities do not always provide sufficient noise attenuating qualities throughout the engine operating speed range. In a typical installation, a silencer made in accordance with the present invention is 0.2 to 0.4 metre diameter, preferably 0.3 metre diameter. The silencer is preferably placed 1 metre downstream of the water coolant spray. If turbochargers are fitted, typical outlet diameters are 0.2 metre and water coolant spray outlet nozzle is situated at a bend in the pipe.

A preferred material for the manufacture of the silencer is stainless steel, preferably a marine grade such as 316, by reasons of its high corrosion resistance. However, other cheaper materials may be employed. Suitable fire-retardant, synthetic resin-impregnated fibres can also be employed, some of which, because of their resilience, may achieve higher levels of noise attenuation.

Although the embodiment shown in FIGS. 3 to 5 comprises a reverse cone arrangement, it is equally possible for the apex of the cone to be directed towards the exhaust gas flow. Other baffle shapes can be employed which allow a high surface area for a given cross-sectional area of exhaust conduit.

FIG. 6 shows an external view of the silencer casing and the connections with the engines. Exhaust gases from the engine or engines (in this case two), are fed into separate pipes 61,62 into which water is injected from the cooling water system. Pipes 61 and 62 merge together in a connector housing 63 which connects pipes 61 and 62 to a conduit 10 which constitutes the exhaust pipe and is constructed as shown in FIGS. 2 to 5.

FIG. 7 is an end view of a modified silencer showing a weir plate 71. The weir plate is normally a continuous, non-perforated plate which extends generally in line with the axis of the silencer body 20. Plate 71 may be angled downwardly in order to increase deflection of water through holes in the cone 20. In FIG. 3, the weir plate is shown in broken lines. At the open end of the silencer body, the lower part of the mouth of the silencer is partly closed off with a throttle plate 72, which may be formed with one or more apertures 73 through which exhaust gas and water may enter the lower part of the silencer body. Typically, the height of the weir plate from the base of the silencer body (dimension 'A'), is about 20 to 30 mms, while the overall diameter of the silencer mouth will be about 200 to 400 mms, preferably 250 to 350 mms.

An important consideration for selecting a suitable baffle is one which allows a smooth flow of gas to limit power reducing turbulences. A tapering, tubular-shaped baffle which tapers in the direction of flow is therefore preferred. Where conical baffles are selected, their cross-section need not be circular and additional surface area may, for example, be provided by corrugating the surface with radial or axial corrugations. Such corrugations, it is thought, increase the cooling area to exhaust gas volume ratio and thus further reduce the exhaust gas velocity and the back pressure.

I claim:

1. A silencer for a water-cooled exhaust gas system having an exhaust duct for conducting a flow of exhaust gases there along, said system comprising a tubular silencer element located within the exhaust duct, said silencer element comprising a baffle having an inlet and apertured surfaces inclined to the flow of exhaust gas in the duct, wherein the silencer element includes a weir plate, the weir plate extending within the silencer element from said inlet in the direction of said exhaust gas flow.

2. A silencer according to claim 1 wherein the silencer element is generally conical.

3. A silencer according to claim 2, wherein the silencer element has a base and an apex and an axis passing through the base and apex and said element has a cone angle of between 10° and 40°, the cone angle being measured by taking an imaginary cross-section through the element along said axis and measuring the angle between opposite sides passing through the apex.

4. A silencer according to claim 3, wherein the exhaust duct has substantially mutually parallel internal walls, the silencer element extends within the exhaust duct with the base of said silencer element contacting the walls of the duct, wherein the apertured surface of the silencer element forms an angle ($\beta$) with a wall of the exhaust duct of between 5° and 20°.

5. A silencer according to claim 3 wherein the exhaust duct is cylindrical.

6. A silencer according to claim 5 wherein the exhaust duct has an axis extending lengthwise thereof and the axis of the silencer element is substantially aligned with the axis of the exhaust duct.

7. A silencer according to claim 1 wherein there is a radially extending gap between the weir plate and the apertured surface of the baffle at the inlet of said silencer element and wherein said gap is closed by a throttle plate.

8. A silencer according to claim 3 wherein the cone angle is between 15° and 30°.

9. A silencer according to claim 6 wherein said axes are substantially coaxial.

10. A silencer according to claim 3 wherein the silencer element is conical and tapers in the direction of flow of the exhaust gases.

11. A silencer according to claim 10 wherein the silencer element has a rounded apex.

12. A silencer according to claim 1 wherein the total area of the apertures in the silencer element as a percentage of the total area of the surface of said element is from about 10 to 40%.

13. A silencer according to claim 7 wherein the throttle plate is apertured.

* * * * *